US012508471B2

(12) United States Patent
Lee

(10) Patent No.: US 12,508,471 B2
(45) Date of Patent: Dec. 30, 2025

(54) WHEELCHAIR LOWER BODY EXERCISE DEVICE

(71) Applicant: Husang Lee, Newton Highlands, MA (US)

(72) Inventor: Husang Lee, Newton Highlands, MA (US)

( * ) Notice: Subject to any disclaimer, the term of this patent is extended or adjusted under 35 U.S.C. 154(b) by 53 days.

(21) Appl. No.: 18/636,617

(22) Filed: Apr. 16, 2024

(65) Prior Publication Data

US 2025/0256155 A1 Aug. 14, 2025

(30) Foreign Application Priority Data

Feb. 14, 2024 (KR) ..... 10-2024-0021071

(51) Int. Cl.
*A63B 23/08* (2006.01)

(52) U.S. Cl.
CPC ..... *A63B 23/08* (2013.01); *A63B 2208/0228* (2013.01)

(58) Field of Classification Search
CPC ..... A63B 23/08; A63B 2208/0228
See application file for complete search history.

(56) References Cited

U.S. PATENT DOCUMENTS 5,033,736 A * 7/1991 Hirschfeld ..... A61H 1/0214 601/36
5,284,131 A * 2/1994 Gray ..... A61H 1/0214 601/36
7,993,247 B1 * 8/2011 Eschenbach ..... A63B 22/0664 482/52
2005/0209063 A1 * 9/2005 Kassel ..... A61H 1/0262 482/60
2012/0190511 A1 * 7/2012 Sprague ..... A63B 23/0405 482/91
2014/0336017 A1 * 11/2014 Staten ..... A63B 23/1227 482/98
2022/0331177 A1 * 10/2022 Guo ..... A63B 21/151
2023/0146049 A1 * 5/2023 Aoki ..... A63B 22/0023 482/7
2025/0049619 A1 * 2/2025 Chizhov ..... A63B 22/0605
2025/0205537 A1 * 6/2025 Horn ..... A63B 21/00047

* cited by examiner

*Primary Examiner* — Andrew S Lo
(74) *Attorney, Agent, or Firm* — Sughrue Mion, PLLC

(57) ABSTRACT

Provided is directed to a wheelchair lower body exercise device allowing lower body exercises to be performed in a wheelchair. In addition, the lower body exercise includes a thigh exercise and a pelvic exercise and provides a remarkable effect of enabling lower body exercises to be performed conveniently and easily even while sitting in a wheelchair.

1 Claim, 7 Drawing Sheets

WHEELCHAIR LOWER BODY EXERCISE DEVICE

CROSS-REFERENCE TO RELATED APPLICATION

This application claims priority under 35 U.S.C § 119 to Korean Patent Application No. 10-2024-0021071 filed on Feb. 14, 2024 in the Korean Intellectual Property Office, the entire contents of which are hereby incorporated by reference.

TECHNICAL FIELD

The disclosure relates to a wheelchair lower body exercise device, and more particularly, to a wheelchair lower body exercise device that allows lower body exercises to be performed conveniently and easily while sitting in a wheelchair.

BACKGROUND

In general, the number of wheelchair users is increasing due to the aging of society, and the development of wheelchairs is on the rise. As one example of prior art patents, Korean Patent Application Publication No. 10-2011-0026281 discloses an exercise assist apparatus for a wheelchair characterized by comprising a first mounting shaft having both ends fixed respectively to end bars at both ends provided on a frame of a wheelchair, mounting holes provided at the both ends of the first mounting shaft and configured to secure the first mounting shaft to the end bars, a housing capable of rotating by a predetermined angle about the first mounting shaft and having a power transmission mechanism installed therein, a pedal rotatably installed at the front end of a crankshaft that is installed at the front end of the housing and is connected to the power transmission mechanism, wherein the feet of a wheelchair rider rest on the pedal, drive wheels rotatably installed at the rear end of the housing and configured to transmit and receive power to and from the crankshaft via the power transmission mechanism, and an elastic member having one end fixed to the frame side and the other end supported on the opposite side of the front end of the housing where the crankshaft is installed with respect to the first mounting shaft of the outer surface of the housing, and configured to cause the drive wheels installed on the housing to be brought into close contact with the ground.

In addition, Korean Patent Application Publication No. 10-2007-0011704 discloses a device configured to convert a motion that moves wheelchair wheels into a linear motion.

However, the conventional techniques had the drawbacks of being unsuitable for lower body exercises, having low exercise efficiency, and being at risk of accidents.

SUMMARY

Therefore, the present disclosure is designed to solve the above problems, and is intended to provide a wheelchair lower body exercise device that allows lower body exercises to be performed conveniently, easily, and safely even while sitting in a wheelchair.

The present disclosure relates to a wheelchair lower body exercise device, wherein lower body exercises are performed in a wheelchair.

In addition, the lower body exercises comprise an ankle exercise, a thigh exercise and a pelvic exercise.

Further, the ankle exercise comprises rotating ankles left and right or forward and backward around a heel.

Therefore, the present disclosure has the remarkable effect of enabling lower body exercises to be performed conveniently and easily even while sitting in a wheelchair.

DETAILED DESCRIPTION OF THE PREFERRED EMBODIMENTS

The present disclosure relates to a wheelchair lower body exercise device, and is characterized in that lower body exercises are performed in a wheelchair.

In addition, the lower body exercises are characterized by including ankle and thigh exercises and a pelvic exercise.

Further, the ankle exercise is characterized by rotating ankles left and right with the heel as the center of rotation.

Moreover, a turntable is installed on a heel lower frame and a torsion coil spring is installed on a turntable rotation shaft, and thus is characterized in that when rotated, it returns to its position by elastic restoring force.

Furthermore, the ankle exercise is characterized by performing an up and down exercise by the toe portion and the foot sole portion relative to the heel, i.e., rotating in the forward and backward directions relative to the heel.

The thigh exercise is characterized in that as exercise plates are installed on the left and right sides of the thigh, respectively, the exercise plates have inner and outer thigh plates installed inside a case, and coil springs are coupled to the inner and outer plates, when the thigh is positioned between the inner and outer sides and the thigh is spread or retract, the exercise is performed by the spring force.

In addition, the pelvic exercise is characterized by rotating the pelvis left and right.

Further, a turntable is installed below the hip and a torsion coil spring is installed on a turntable rotation shaft, and thus is characterized in that when rotated, it returns to its position by elastic restoring force.

Figure 1:
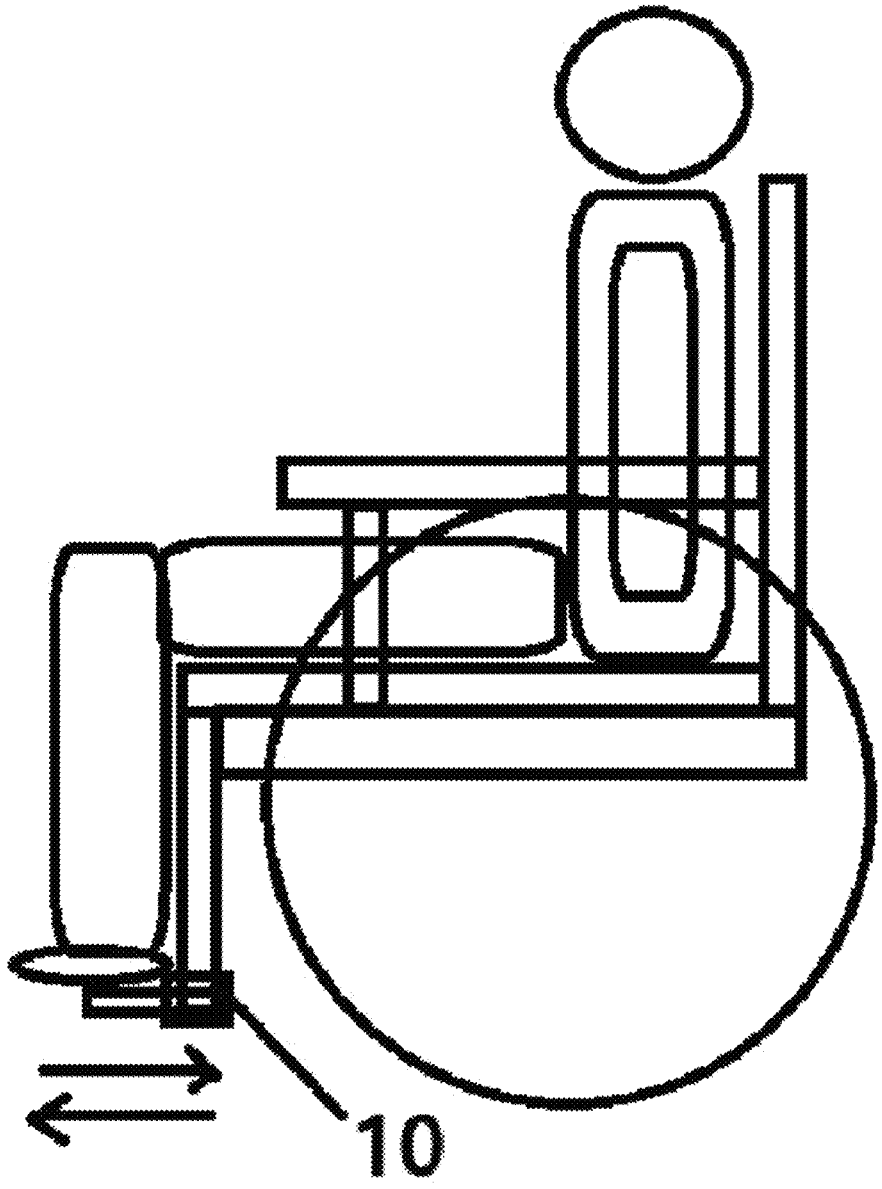
FIG. 1 is a side state diagram in which an ankle exercise module 10 is installed in a wheelchair in accordance with the present disclosure.
Figure 2:
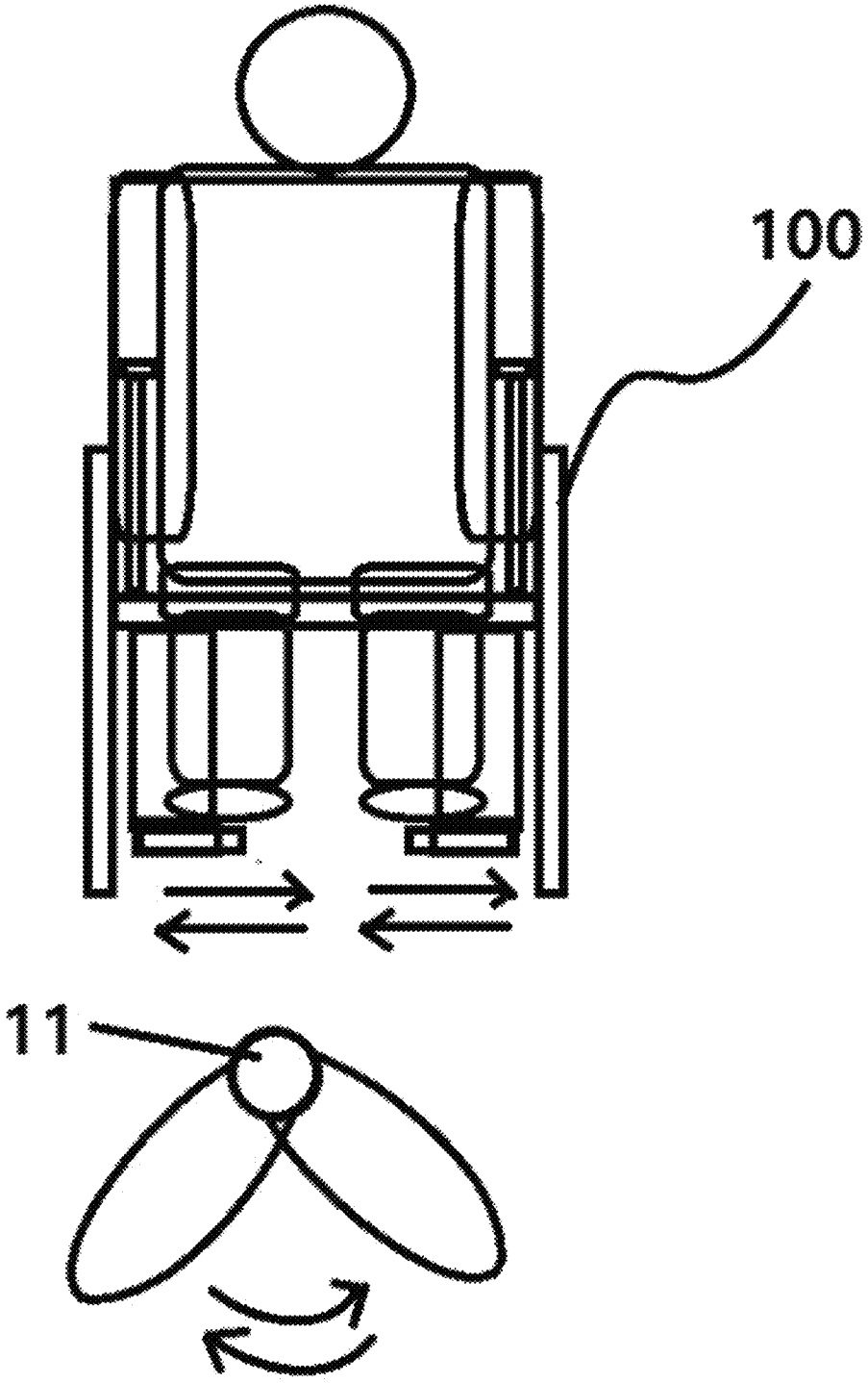
FIG. 2 is a front state diagram in which the ankle exercise module 10 is installed in the wheelchair in accordance with the present disclosure (left and right rotation of the ankle)
Figure 3:
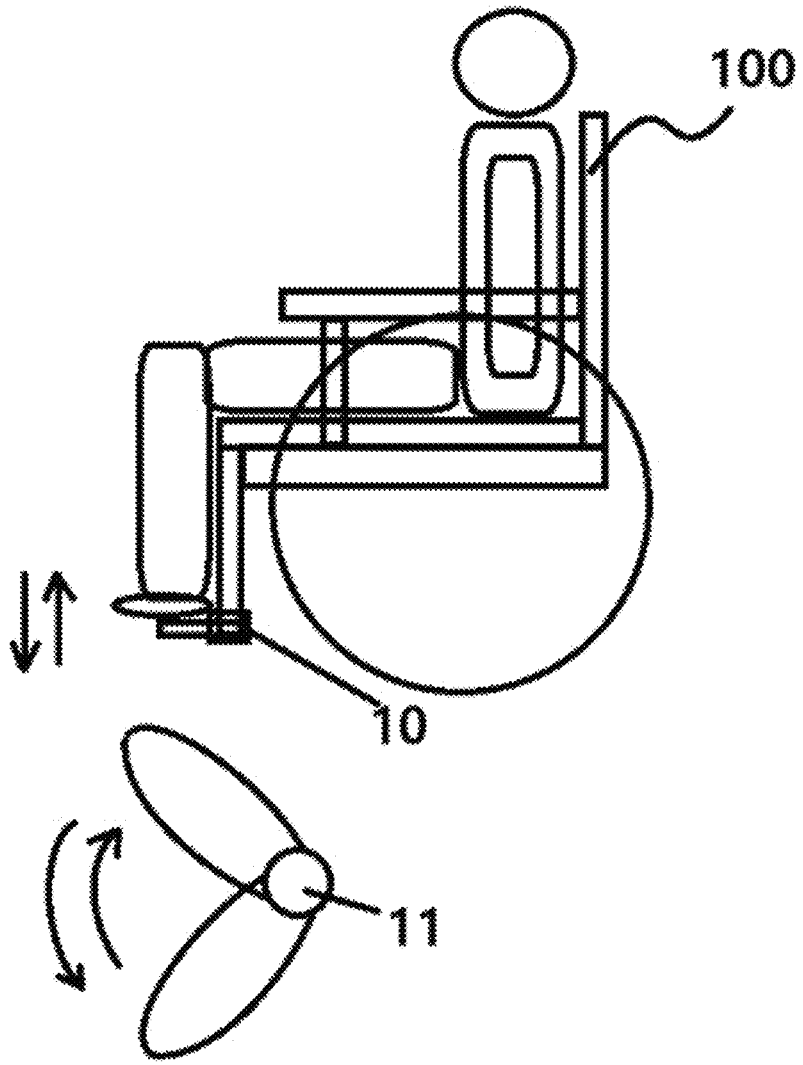
FIG. 3 is a side state diagram in which the ankle exercise module 10 is installed in the wheelchair in accordance with the present disclosure (forward and backward rotation of the ankle)
Figure 4:
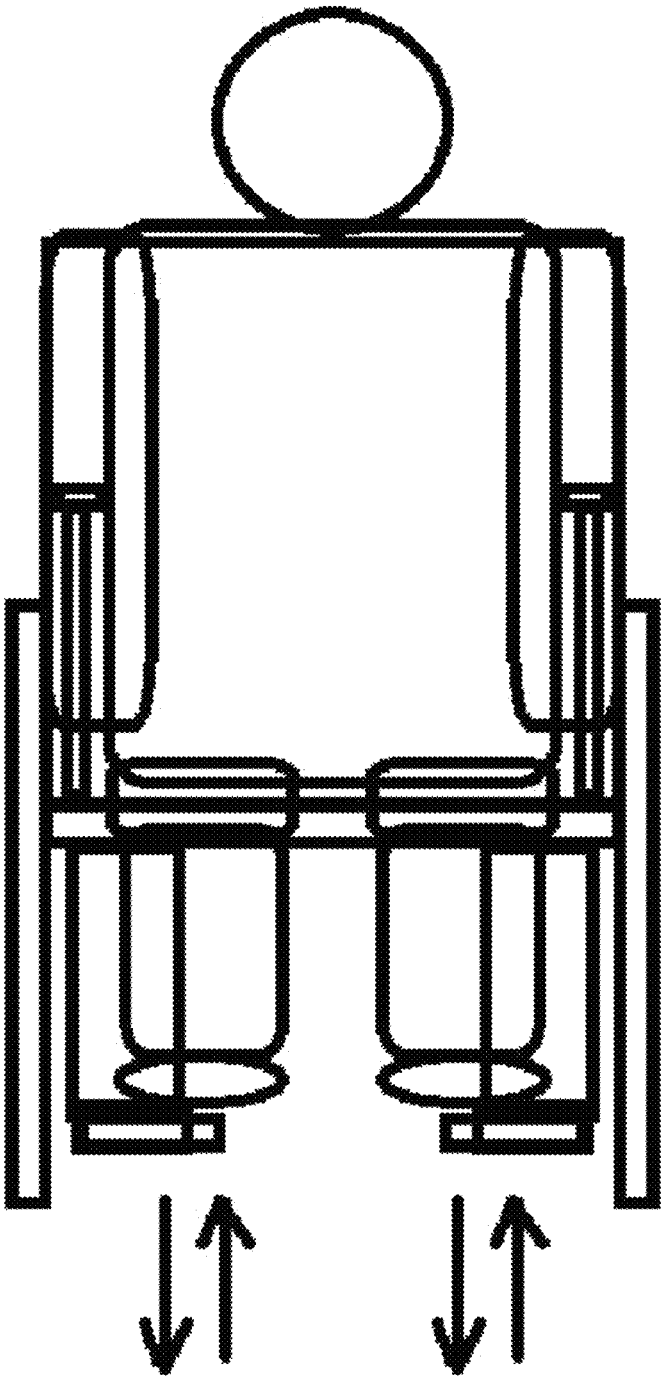
FIG. 4 is a front state diagram in which the ankle exercise module 10 is installed in the wheelchair in accordance with the present disclosure.
Figure 5:
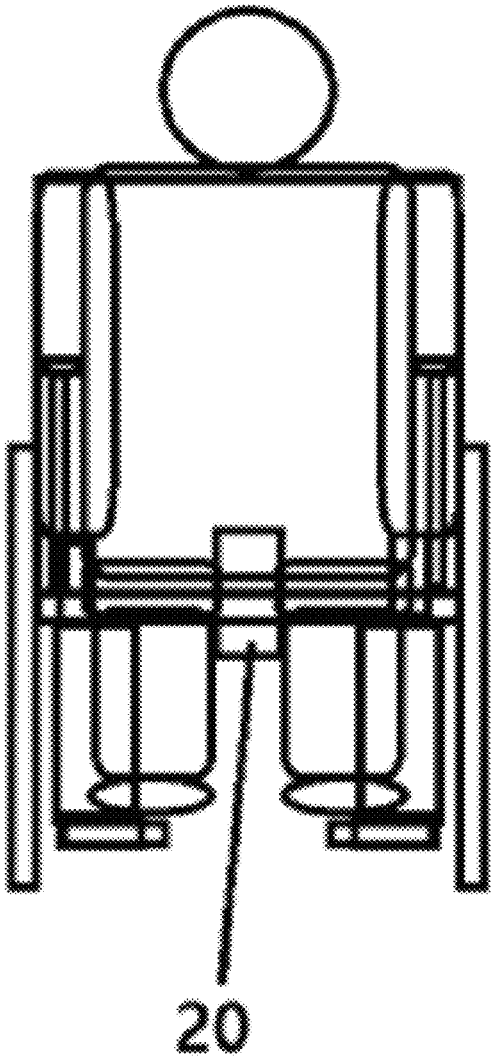
FIG. 5 is a front state diagram in which a thigh exercise module 20 is installed in the wheelchair in accordance with the present disclosure.
Figure 6:
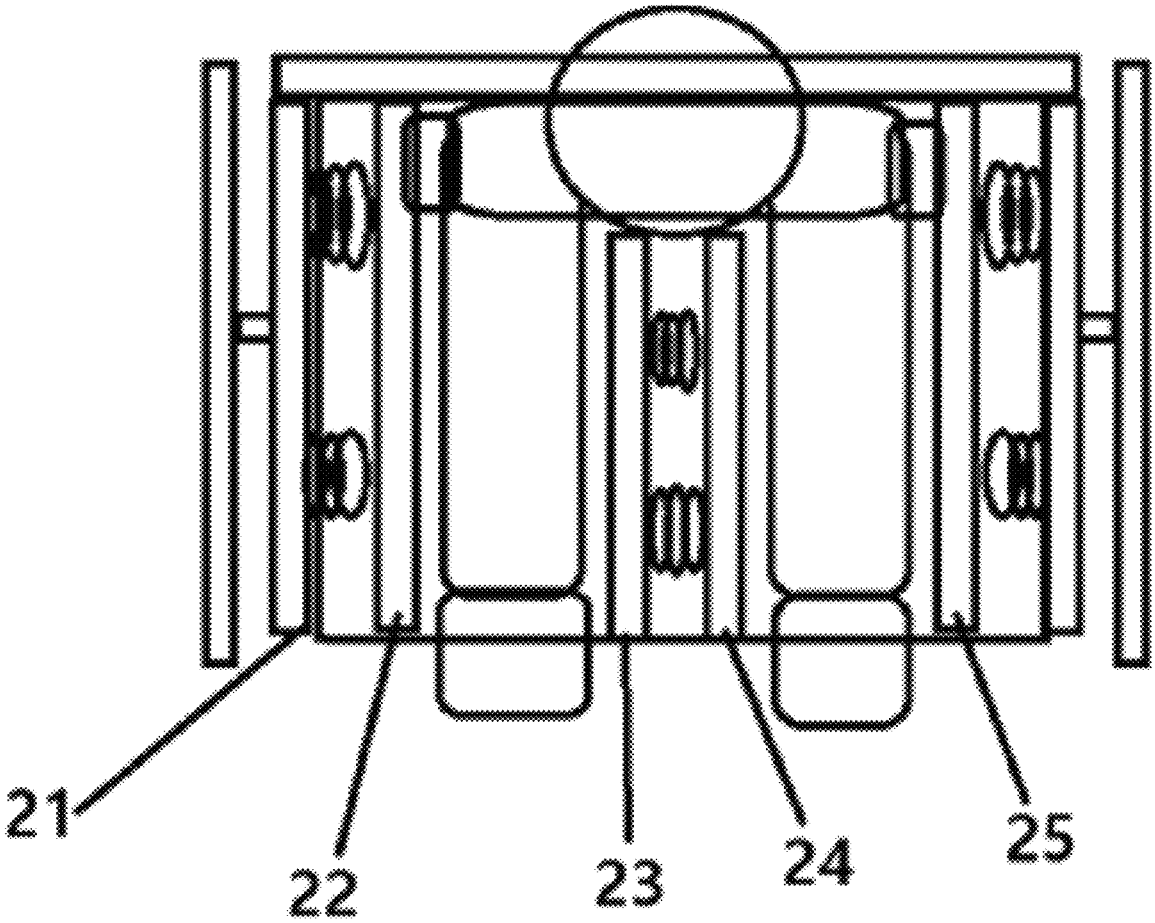
FIG. 6 is a plan state diagram in which the thigh exercise module 20 is installed in the wheelchair in accordance with the present disclosure.
Figure 7:
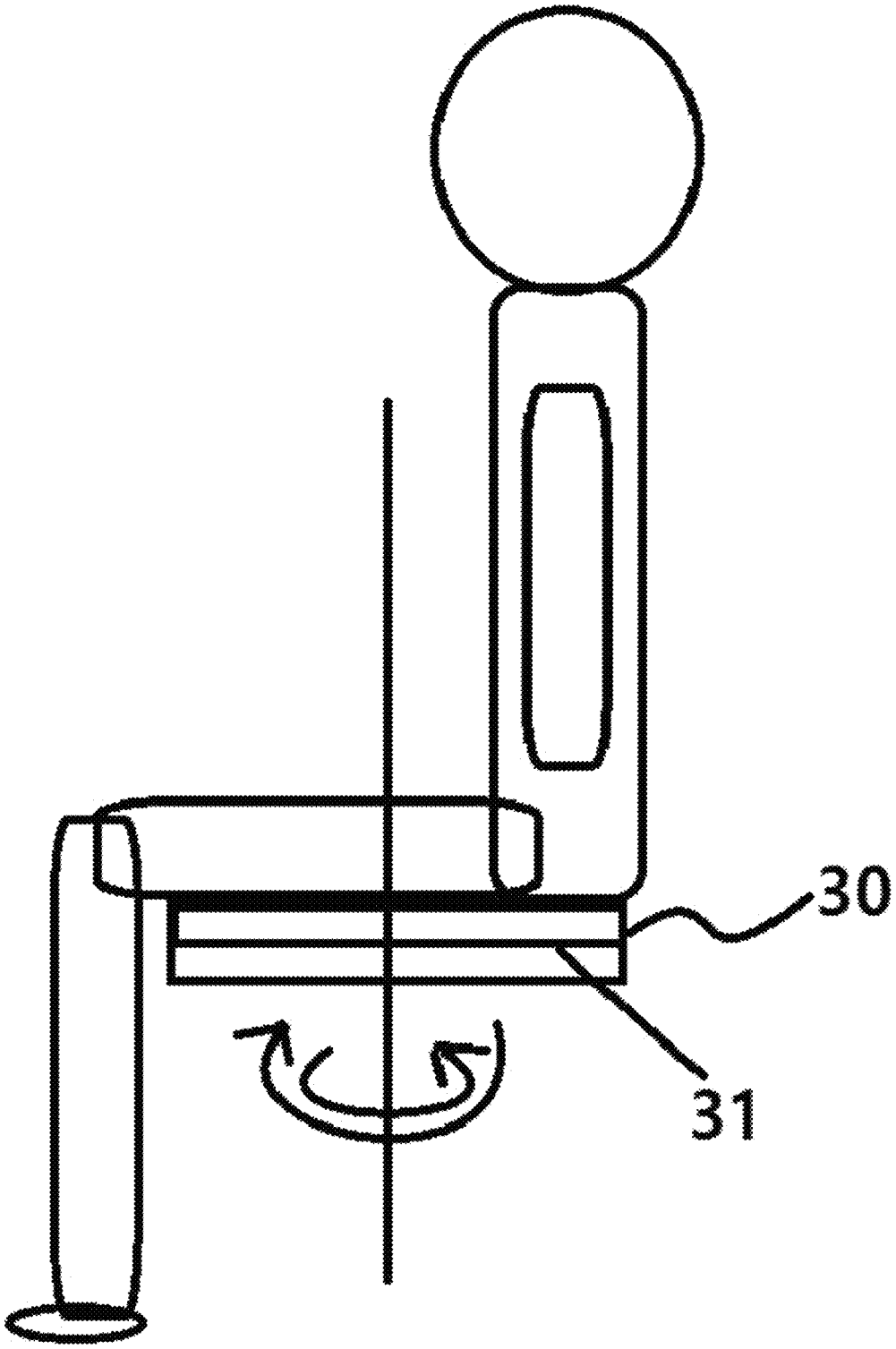
FIG. 7 is a state diagram in which a pelvic exercise module 30 is installed in the wheelchair in accordance with the present disclosure.

The present disclosure will be described in detail with reference to the accompanying drawings as follows. FIG. 1 is a side state diagram in which an ankle exercise module 10 is installed in a wheelchair in accordance with the present disclosure, FIG. 2 is a front state diagram in which the ankle exercise module 10 is installed in the wheelchair in accordance with the present disclosure (left and right rotation of the ankle), FIG. 3 is a side state diagram in which the ankle exercise module 10 is installed in the wheelchair in accordance with the present disclosure (forward and backward rotation of the ankle), FIG. 4 is a front state diagram in which the ankle exercise module 10 is installed in the wheelchair in accordance with the present disclosure, FIG. 5 is a front state diagram in which a thigh exercise module 20 is installed in the wheelchair in accordance with the present disclosure, FIG. 6 is a plan state diagram in which the thigh exercise module 20 is installed in the wheelchair in accordance with the present disclosure, and FIG. 7 is a state diagram in which a pelvic exercise module 30 is installed in the wheelchair in accordance with the present disclosure.

The wheelchair lower body exercise device in accordance with the present disclosure allows for lower body exercises in a wheelchair, and the lower body exercises include ankle and thigh exercises and a pelvic exercise.

For the ankle exercise, when rotating ankles left and right with the heel as the center of rotation, a turntable 11 is installed on a heel lower frame and a torsion coil spring is installed on a turntable 11 rotation shaft, and thus when rotated, it returns to its position by elastic restoring force.

A band for securing the heel may be coupled to the turntable 11, or exercise shoes for securing the heel may be detachably coupled to the turntable 11 with bolts or the like.

As another method, the ankle exercise involves performing an up and down exercise by the toe and the foot sole portion relative to the heel, i.e., rotating in the forward and backward directions relative to the heel.

A hook is attached to the front end of exercise shoes, a string is connected to the hook, and a weight is coupled to the string, so that the user exercises by lifting and lowering the weight. An upper fame horizontal bar is installed for supporting the string with the weight connected thereto. The horizontal bar has a hinge installed at one end and is folded downward in front of the wheelchair frame 100 when not in use, thereby avoiding inconvenience in using the wheelchair. Alternatively, by coupling eccentric weights to the sides of the exercise shoes, the exercise is performed as the toe portion needs to be raised upward by overcoming the weight of the eccentric weight when raising the toe portion upward, i.e., rotating the ankle backward, and when the toe portion is returned downward, the shoe rotates forward by the weight of the eccentric weight, returns to its initial position, and faces downward.

Meanwhile, for the thigh exercise, as a thigh exercise module 20 is installed on the left and right sides of the thigh, respectively, the thigh exercise module 20 has inner plates 23 and 24 for left/right leg exercises and outer plates 22 and 25 for left/right leg exercises installed inside a case 21, and coil springs are coupled to the inner and outer plates 22, 23, 24, and 25 for left and right leg exercises, when the thigh is positioned between the inner and outer sides and the thigh is spread or retract, the exercise is performed by the spring force. In other words, when retracting, the inner plates 23 and 24 for left and right leg exercises are acted on by a compressive repulsive force and the outer plates 22 and 25 for left and right leg exercises are acted on by a tensile repulsive force, and thus the exercise is performed in opposition to the retractive force of the wheelchair user, and the opposite happens in the case of spreading. The thigh exercise module 20 is detachably coupled to the front frame of the wheelchair and can be removed when not in use so as not to interfere with the use of the wheelchair.

The pelvic exercise involves rotating the pelvis left and right, and a turntable 31 is installed below the hip and a torsion coil spring is installed on a turntable 31 rotation shaft, and thus when rotated, it returns to its position by elastic restoring force.

The turntable 31 is installed on the wheelchair frame 100 to be rotated by the rotation shaft.

In addition, the present disclosure has the effect of making it possible to sit in the wheelchair in a correct posture by the pelvic exercise with the turntable 31 or the like. In turn, as the hunched back will straighten out by the exercise, the sitting height will increase as well. In order to measure such posture correction, a weight sensor is installed on the seat chair to measure the body weight.

A body fat measurement sensor and a bone density sensor are installed in the seat chair to measure body fat and body mass index.

BMI is a body mass index and is defined as weight (Kg)/height (m)2. In other words, it is the value obtained by dividing a weight by the square of a height. The numerical value that a person knows may be used as the height, but for disabled people who use seats, their BMI may be calculated, computed, and managed separately through the sitting height. In other words, the weight (Kg)/sitting height (m)2 is calculated, and a control unit presents a health index based on the above values stored in a storage unit. In particular, managing the sitting height is to present a standard for riding the seat properly and moving without causing the back to be hunched. The sitting height can be measured while riding the seat, and a ruler that can be raised upward like an antenna is installed on the chair frame for the seat, the ruler is pulled upward and then a rod of an uppermost horizontal bar is placed horizontally with the hinge as the center of rotation, and the sitting height from the chair frame is measured when the ruler is placed against the head of the user on the chair. If the sitting height is measured after finishing the ankle exercise, thigh exercise, and pelvic exercise, respectively, the degree to which the back is straightened can be seen via a monitor that is an output unit, and the control unit displays the intensity and duration of each exercise to be adjusted.

The measurements can be carried out automatically by an optical sensor with an infrared radar beam, etc., a signal from the optical sensor installed on the chair frame for the seat is transmitted to the control unit, and the control unit measures the sitting height via a calculation unit. At this time, the optical sensor measures the maximum height of the head. The optical sensor may be replaced with a camera module, which may then be used. When a camera image is inputted via an image input unit of the controller, it is filtered and made clearer by an image processing unit, and the head of the human body, which is machine-learned, is identified by an AI module using OPENCV, YOLO, etc., and the sitting height is measured. Meanwhile, if the back is hunched in the camera image, the control unit outputs an audio to straighten the back via a speaker of the output unit. For the degree to which the back is hunched, an angular error from the reference vertical line is set in advance, and an audio is outputted if the above angle is exceeded. For this purpose, an anthropometric AI module using OPENCV, YOLO, Media Pipe, etc., is used. Then, when a processed signal is created by implementing with TensorFlow or PyTorch, the control unit generates an audio signal via the output unit by the above signal.

The sitting height data is automatically stored in the storage unit, and the control unit calculates the value of weight (Kg)/sitting height (m)2 and presents it to the screen monitor, which is the output unit. Then, the control unit compares a standing height, which is a body index stored in advance, with the sitting height, presents a proportional value of the sitting height, which is proportional to the increase or decrease in the overall height, to the overall height, and makes it possible to correct body imbalance, sitting posture in the wheelchair, and the like, by the degree to which the sitting height of the disabled person increases or decreases in proportion to the overall height.

The controller comprises a control unit, an input/output unit such as a touchpad and a touchscreen, and a storage unit that stores data.

The body fat analysis sensor analyzes body fat and the like by the control unit with a resistance value (impedance) generated by passing a weak current of about 400 microamps through the human body, and the body mass index is a value obtained by dividing the weight (kg) by the square of the height (m).

BMI (body mass index) is an approximate body mass index calculated from height and weight.

The controller in accordance with the present disclosure is equipped with an AR module and can thus efficiently and accurately manage health data.

Therefore, the present disclosure has the remarkable effect of enabling lower body exercises to be performed conveniently and easily even while sitting in a wheelchair.

DESCRIPTION OF REFERENCE NUMERALS AND SYMBOLS

100: Wheelchair frame
10: Ankle exercise module
11: Turntable
20: Thigh exercise module
21: Case
22: Outer plate for right leg exercise
23: Inner plate for right leg exercise
24: Inner plate for left leg exercise
25: Outer plate for left leg exercise
30: Pelvic exercise module
31: turntable

What is claimed is:

1. A wheelchair lower body exercise device, wherein lower body exercises are performed in a wheelchair, and an ankle exercise module, a thigh exercise module and a pelvic exercise module are installed in the wheelchair, and wherein the ankle exercise module is configured to rotate ankles left and right or forward and backward around a heel, wherein the thigh exercise module is configured to perform thigh exercises by a spring force when a user's thigh is positioned between an inner plate and an outer plate for leg exercise, to which coil springs are coupled, and the thigh is spread or retracted, wherein the pelvic exercise module is configured to rotate the user's pelvis left and right using a turntable, on which a torsion coil spring is installed, and wherein a body fat measurement sensor and a bone density sensor for measuring body fat and body mass index are installed in a seat chair of the wheelchair.

* * * * *